US005441245A

United States Patent [19]

Flückiger

[11] Patent Number: 5,441,245

[45] Date of Patent: Aug. 15, 1995

[54] PROCESS AND APPARATUS FOR OPENING MULTI-SHEETED PRODUCTS, IN PARTICULAR PRINTING PRODUCTS

[75] Inventor: Hans W. Flückiger, Oetwil am See,

[73] Assignee: Ferag AG, Hinwil, Switzerland

[21] Appl. No.: 75,750

[22] Filed: Jun. 11, 1993

[30] Foreign Application Priority Data

Jun. 11, 1992 [CH] Switzerland ..... 01858/92

[51] Int. Cl.[6] ..... B65H 5/30

[52] U.S. Cl. ..... 270/57

[58] Field of Search ..... 270/55, 57

[56] References Cited

U.S. PATENT DOCUMENTS

| | | | |
|---|---|---|---|
| Re. 31,710 | 10/1984 | Jackson | 270/57 |
| 1,616,061 | 1/1927 | Nelson | 270/57 |
| 3,595,560 | 7/1971 | Hannon et al. | 270/57 |
| 3,722,877 | 3/1973 | Wetter | 270/57 |
| 3,951,399 | 4/1976 | Reist . | |
| 4,058,202 | 11/1977 | Reist et al. . | |
| 4,398,710 | 8/1983 | Hänsch . | |
| 4,401,300 | 8/1983 | Morin | 270/57 X |
| 4,420,146 | 12/1983 | Reist | 270/55 |
| 4,478,399 | 10/1984 | Morin et al. | 270/55 |
| 4,486,011 | 12/1984 | Rhunke | 270/55 |
| 4,784,379 | 11/1988 | Vander Syde et al. | 270/55 |

FOREIGN PATENT DOCUMENTS

| | | | |
|---|---|---|---|
| 2076005 | 10/1971 | France . | |
| 376940 | 6/1964 | Switzerland . | |
| 641113 | 2/1984 | Switzerland . | |
| 302260 | 9/1971 | U.S.S.R. | 270/57 |

*Primary Examiner*—John E. Ryznic

*Attorney, Agent, or Firm*—Bell, Seltzer, Park & Gibson

[57] ABSTRACT

The opening apparatus has an opening element with a resting surface and a stabbing member, the pointed stabbing end of which is offset by a predetermined distance with respect to the resting surface. The printing product to be opened is held together between the resting surface and the counter-element. Upon pivoting of the opening element in stabbing direction, the stabbing member stabs in between sheets of the printing products, which are lifted off one another upon further pivoting of the opening element.

16 Claims, 5 Drawing Sheets

Z
32
10
46'
24
58
18'
66
47
23'
18

30
24
26
52
E
18'
34

10
18
18'
E'
47'

10
56'
18
18'
E2
52
30'
56

24
34
18
18'
66
23

10
56'
30
66
18'
LF
23'
56
30'
36

PROCESS AND APPARATUS FOR OPENING MULTI-SHEETED PRODUCTS, IN PARTICULAR PRINTING PRODUCTS

The present invention relates to a process and an apparatus for opening folded, bound or stapled multi-sheeted products, and in particular printing products. Furthermore, the invention relates to a device for processing in particular inserting, printing products.

A process and an apparatus of this type are known from U.S. Pat. No. 4,420,146. The folded product to be opened, resting on a flat supporting element, is moved with an open side ahead onto a fixed opening element. This opening element has a flat tongue-like stabbing member, which is fastened on a shaft which runs approximately parallel to the supporting element and at right angles to the conveying direction of the product. The stabbing member is rotatable with this shaft and, in its starting position, points with its pointed stabbing end toward the oncoming product. With this stabbing end, the stabbing member stabs in between sheets of the product. Subsequently, the shaft is turned together with the stabbing member about its longitudinal axis, during which the advancing movement of the product continues. By this turning of the stabbing member, the part of the product resting on it is lifted off the other part, facing the supporting element so that the product is opened. During the course of the further movement of the product, a fixed separating member enters between the open parts and opens the product completely. Further products can then be placed into the held-open product. As soon as the opened product has been moved completely past the stabbing member, the opening element is turned back again into its starting position.

This process and the corresponding apparatus allow only the opening of moved products. Furthermore, the fed product may be fanned in the region of the open side, so that the product is opened between incorrect sheets. Moreover, in the case of the known apparatus, setting operations which have to be carried out with precision are necessary in each case for processing products of different thicknesses.

It is therefore an object of the present invention to develop the known process and the known apparatus further in such a way that even stationary products can be reliably opened at the correct point.

This object is achieved by a process and an apparatus according to the present invention.

Since, according to the invention, the product is held together at the stabbing region between a counter-element and a resting surface of the opening element, the sheets of the product always lie against one another in a defined manner during stabbing with the stabbing member. Also, the product itself provides the reference for the point where stabbing is carried out with the stabbing member, since according to the invention the stabbing end of the stabbing member is offset by a predetermined distance with respect to the resting surface. Consequently, products of different thicknesses are always opened approximately at the same point.

In the case of a particularly preferred embodiment of the process and configuration of the apparatus, the product is smoothed before opening, in that the opening element pressing against the product is first moved against the stabbing direction. As a result, an exact reference for stabbing at the correct point is created, even if sheets happen to be bent or creased.

Furthermore, a preferred device for processing, in particular inserting, printing products, with an apparatus according to the invention for opening these printing products, is disclosed.

BRIEF DESCRIPTION OF THE DRAWINGS

The present invention is now explained in more detail with reference to the drawing, in which, like numerals reference like parts.

DETAILED DESCRIPTION

Figure 1:
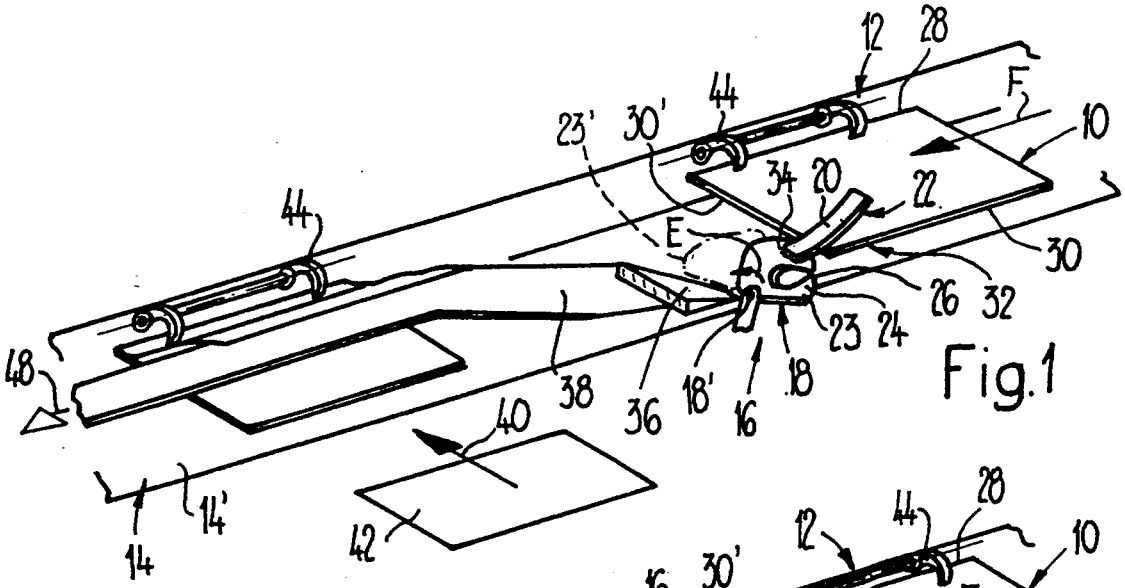
FIG. 1 perspectively shows a part of a device for processing printing products, the printing products being transported while resting on a supporting element, and the reference for the opening being provided by the side of the printing product facing the supporting element.

FIG. 1 shows a part of a device for processing folded printing products 10, which are transported step by step in conveying direction F by means of a transporting device 12. The printing products 10 rest with one of their flat sides on a flat supporting element 14 and are fed to an opening apparatus 16. During this feeding, the printing product 10 in each case comes to bear with the flat side, facing the supporting element 14, on an opening element 18 designed like a disk segment, and is pressed with low force against said element by means of a self-springing pressure-applying element 20, so that the printing product 10 is just held together with sheets bearing against one another. The pressure-applying element 20 consequently forms a counter element 22, interacting with the opening element 18. For opening the printing product 10, the opening element 18 is swivelled out of the starting position 23, indicated by solid lines, in the stabbing direction E into an open position 23', represented by dot-dashed lines. The pivot axis 18' of the opening element 18 in this case runs substantially at right angles to the conveying direction F and to the supporting surface 14' of the supporting element 14. Upon pivoting of the opening element 18, the latter stabs by a stabbing member 24, with the pointed stabbing end 26 thereof, into the open side 30, opposite the back margin 28 of the folded printing product 10 running in conveying direction F, in a stabbing region 32 between sheets of the printing product 10 held together in this region between the pressure-applying element 20 and the opening element 18. For this purpose, the stabbing end 26 of the stabbing member 24 is offset by predetermined distance A in the direction toward the pressure-applying element 20, acting as counter-element 22, with respect to a resting surface 34 of the opening element 18, which surface is at right angles to the pivot axis 18' and against which the printing products 10 bears in the starting position 23 of the opening element 18. This distance A consequently defines exactly the point where stabbing into the printing product 10 occurs, since the latter bears under the action of the pressure-applying element 20 against the resting surface 34 in a defined manner. Consequently, after stabbing until in the open position 23', the printing product 10 is opened further by the opening apparatus 16 from the open side 30 in the region of the corner to the likewise open, leading side 30', by further pivoting of the opening element 18 in that the sheets lying on the stabbing member 24 are, in certain regions,lifted off the remaining sheets, ie. those between the supporting element 14 and the stabbing member 24.

The printing product 10, now partially opened in the region of the leading side 30', is moved in conveying direction F toward a fixed separating member 36, which enters between the sheets lifted off one another and becomes wider in a wedge-shaped manner, and is moved past said member. As a result, said sheets are lifted further off one another and the then entirely opened printing product 10 is held open during further transport by a fixed, rail-like holding-open member 38. At a feeding point 40, a supplement 42 is then introduced into the open printing product 10.

The transporting device 12 is of a generally known type and has controllable clips 44 driven back and forth in conveying direction F (see in this respect CH-A-575 303 and U.S. Pat. No. 4,058,202). For taking along the printing products 10 in conveying direction F, clips 44 are transferred into the closed position, where they firmly clamp the respective printing product 10 at the back margin 28 and take it along. During the return travel, the clips 44 are open, so that the printing products 10 are stationary with respect to the supporting element 14. It goes without saying that the opening apparatus 16, the separating member 36 and the holding-open member 38 are located outside the effective area of the clips 44.

Figure 2:
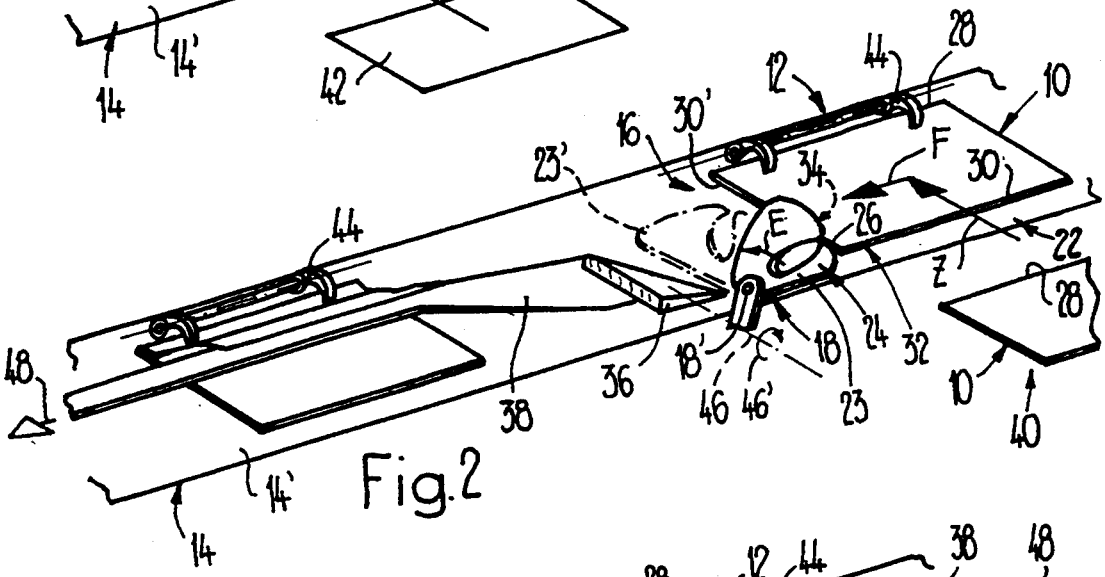
FIG. 2 shows in the same representation as FIG. 1 a part of a further embodiment of the device with a design of the apparatus for opening the printing products in which the side of the printing product facing away from the supporting element forms the reference for opening.

The processing device according to FIG. 2 also has a flat supporting element 14, bearing on which the printing products 10 are transported in conveying direction F by means of the transporting device 12. In contrast to the configuration according to FIG. 1, however, here the printing products 10 are firstly fed in feeding direction Z with the back margin 28 ahead to the processing device. During this feeding, they come to bear with one flat side on the supporting element 14 and with their back margin 28 in the effective area of the clips 44, which are of course opened during introduction and are subsequently transferred into the closed position for firmly holding the printing products 10.

The opening apparatus 16 is arranged at the feeding point 40 for the printing product 10 and, in order to permit the feeding, the opening element 18 can be swivelled about a swivel axis 46, which runs parallel to the supporting surface 14 and approximately at right angles to the conveying direction F, in a direction against the arrow 46' into a position of rest 47, remote from the supporting element 14. As soon as a printing product 10 has been fed through between the supporting element 14 and the opening element 18 to the clips 44 of the transporting device 12, the opening element 18 is swivelled in arrow direction 46' into a pressure-applying position 47', where said opening element comes to bear on the printing product 10, on the flat side facing away from the supporting element 14. Here, the supporting element 14 is the counter-element 22, by which, together with the opening element 18, the printing product 10 is then held together in the stabbing region 32. By pivoting the opening element 18 out of the open position 23', which is indicated by dot-dashed lines in FIG. 2 and in which the opening element 18 is located during lowering onto the printing product 10, against the stabbing direction E into the starting position 23, the printing product 10 is then smoothed at the stabbing region 32. During this smoothing, as soon as the stabbing end 26 has run off the printing product 10, the opening element 18 rests with its resting surface 34 on the printing product 10 and, since in this case the stabbing end 26 of the stabbing member 24 is spaced apart from the resting surface 34 in the direction toward the supporting element 14 by distance A, after reversing the direction of pivoting the stabbing member 24 stabs with the stabbing end 26 between sheets of the printing product 10 in the stabbing region 32 on the open side 30. By further pivoting of the opening element 18 in stabbing direction E, these sheets are then lifted further off one another, in that the sheets resting on the stabbing member 24 on the side facing away from the supporting element 14 are raised. It is to be noted that, upon reaching the open position 23' again, the opening element 18 has run off the printing product 10 with its resting surface 34, but remains in the opened printing product 10 with its stabbing member 24.

The printing product 10 is then moved by means of the transporting device 12 in conveying direction F, likewise with its opened side 30' ahead, toward a fixed separating member 36 and past the latter, where the printing product 10, partially opened by means of the opening element 18, is then opened completely. Seen in conveying direction F, arranged downstream of the separating element 36 there is in turn a profile-like holding-open member 38, in order to hold open the opened printing product 10. At a further feeding point 40, a supplement 42 can then in turn be inserted into said printing product.

Figure 3:
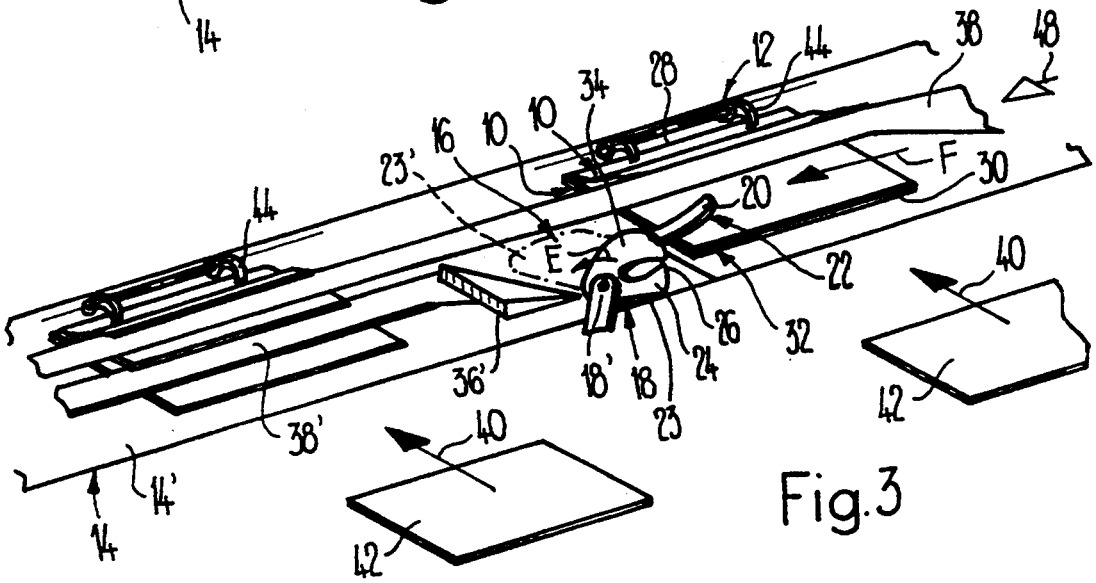
FIG. 3 shows in the same representation as FIG. 1 and FIG. 2 a further part, arranged downstream from the part of the device shown in said figures, with a device for opening a second printing product, lying underneath the already opened printing product.
Figure 4:
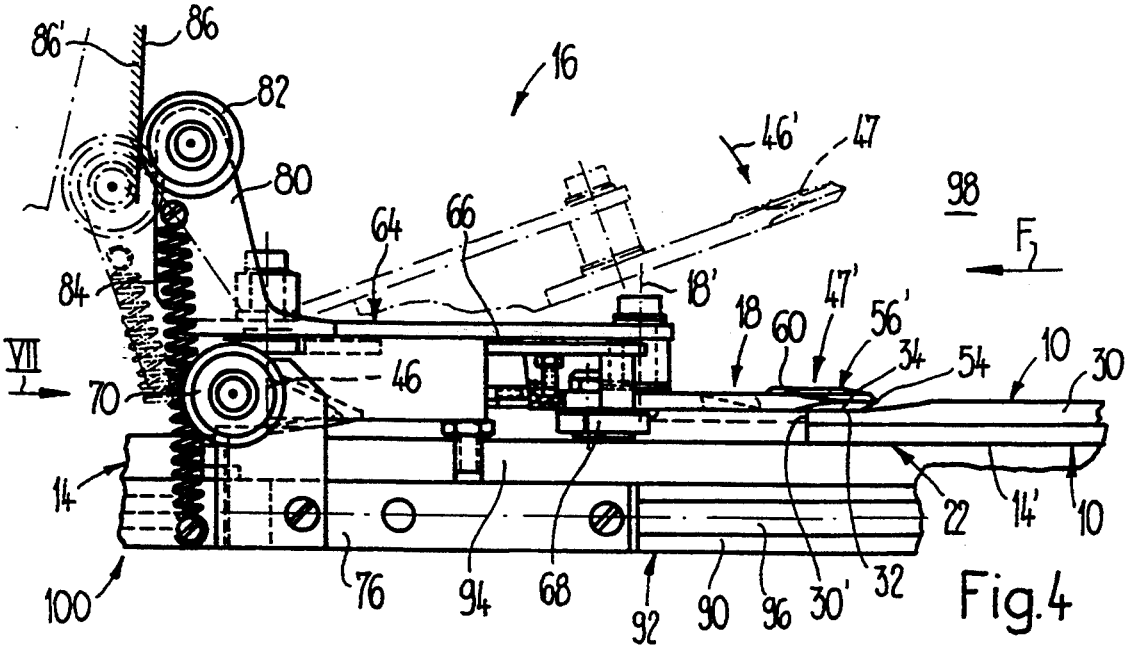
FIGS. 4 and 5 show enlarged a part of the device according to FIG. 2, in elevation and plan view, respectively.

As indicated by the arrows 48, the part of the device for processing printing products which is shown in FIG. 3 is arranged downstream of the part shown in FIG. 1 or in FIG. 2. However, it is to be noted that, according to FIG. 3, in each case two printing products 10 lie congruently one on the other and, held by the clips 44, are transported with each other in conveying direction F. If the part according to FIG. 3 is arranged downstream of a part according to FIG. 1, a second printing product 10 is introduced between the supporting element 14 and the printing product 10, already opened by means of the part according to FIG. 1, in a known manner at a feeding point between these two parts. If, on the other hand, the part according to FIG. 3 is arranged downstream of a device part according to FIG. 2, two printing products 10 may be fed with each other and lying one on the other in direction Z at the feeding point 40 according to FIG. 2, the respectively upper-lying printing product 10 being opened by means of the opening apparatus 16. The respectively already opened printing product 10 is held open by means of the holding-open member 38 also in the region of a second opening device 16, shown in FIG. 3. With this opening device 16, which corresponds to the configuration according to FIG. 1, the respectively lower-lying printing product 10, ie. the product bearing against the supporting element 14, is then opened. Said lower product in turn comes to bear on the resting surface 34 of the opening element 18 and is pressed thereagainst by means of the self-springing pressure-applying element 20, acting as counter-element 22. During this pressing, the sheets of the previously opened printing product 10 which are facing the supporting element 14, with respect to the holding-open member 38, are also pressed together; however, this is irrelevant, since the reference for stabbing with the stabbing member 24 is provided by the lower-lying printing product 10, bearing against the resting surface 34. While stabbing into this printing product 10 is then being carried out in the region of the side 30 and said product is thus opened also in the region of the leading side 30', at the same time a supplement 42 is introduced into the upper-lying, already previously opened printing product 10. This supplement 42 is then further transported together with the two printing products 10 in conveying direction F, the lower-lying printing product 10, facing the supporting element 14, likewise being also opened completely by means of a separating member 36'. A likewise fixed holding-open member 38', arranged downstream of the separating member 36', prevents closing of this printing product 10, into which a supplement 42 is likewise introduced at a further feeding point 40.

The opening apparatus 16, represented in greatly simplified form in FIG. 2, is now described in more detail with reference to FIGS. 4 to 7. The opening element 18 of the opening apparatus 16 is designed like a disk segment and has a passage 52, running transversely to the resting surface 34. Said passage is open at the radially outer edge 54 of the opening element 18, with respect to the pivot axis 18'. The planar resting surface 34 is made on the part 56 of the opening element 18 ahead of the passage 52, seen in stabbing direction E, and the stabbing element 24 is formed onto the part 56' following the passage 52. As FIG. 6 shows in particular, the pointed stabbing end 26 of the substantially flat stabbing member 24 stands out by the distance A with respect to the resting surface 34. In this figure, the flat side of the printing product 10 facing the opening element 18 is indicated by dot-dashed lines. On this side facing the printing product 10, and consequently the resting member 22, a region 58 adjoining the stabbing end is made planar and parallel to the resting surface 34. The opening element 18 located in open position 23' comes to bear with this region on the printing product 10 upon moving into the pressure-applying position 47'. In cross section, the stabbing member 24 is of a wedge-shaped design and, after stabbing, lifts with the side facing away from the region 58 the sheets of the printing product 10 under which it engages off the other sheets in a planing manner, the lifted-off sheets engaging in the passage 52, as still to be described with reference to FIGS. 10 to 15. At the end region remote from the stabbing end 26, the following part 56' has on the upper side, facing away from the resting member 22, a ramp-like thickened portion 60, which projects with respect to the remaining part of the opening element 18, in order to lift the sheets of the printing products 10 further off one another after stabbing during further pivoting of the opening element 18 in stabbing direction E.

Figure 5:
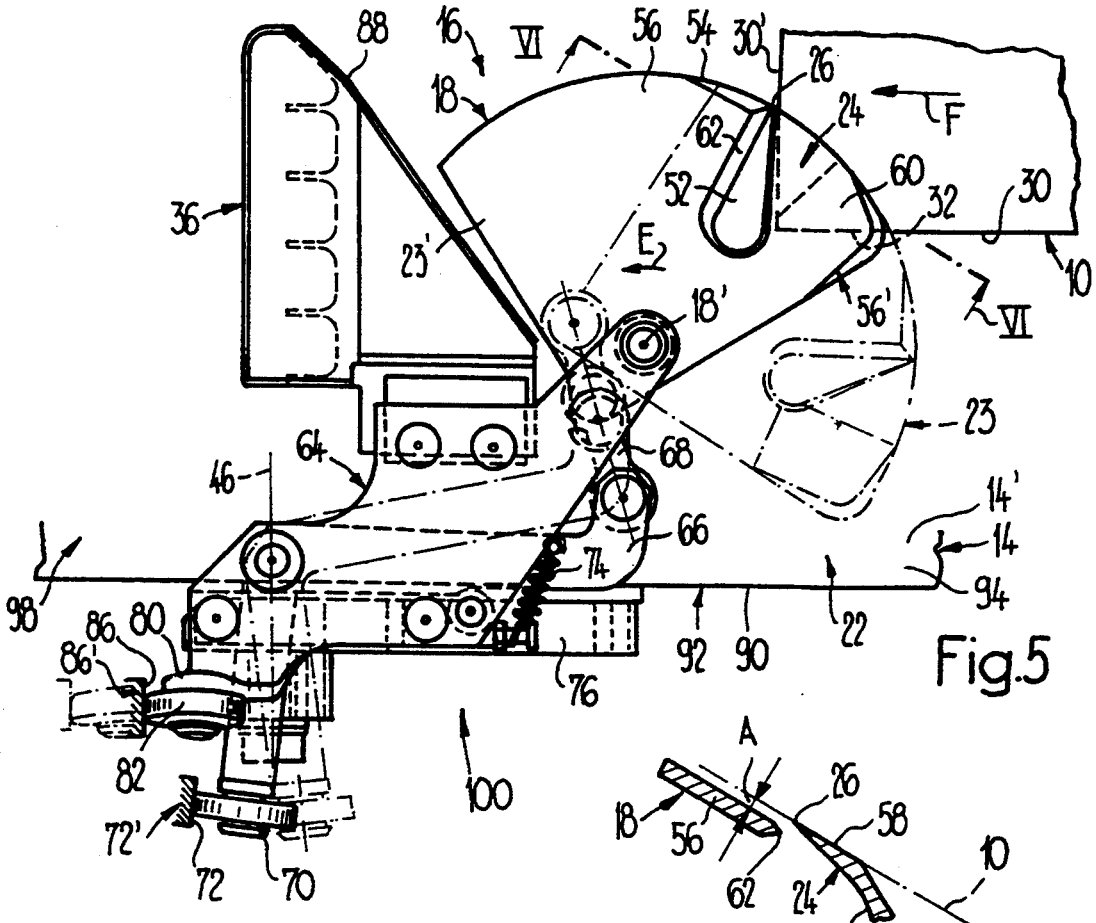
Figure 6:
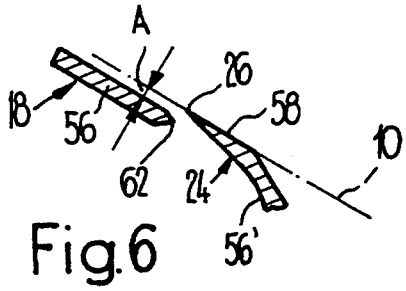
FIG. 6 shows a section along the line VI—VI of FIG. 5.

The edge region 62 of the ahead part 56 of the opening element 18, facing the passage 52, is likewise of a wedge-like design, as FIGS. 5 and 6 in particular reveal. With opening element 18 swivelled back into the open position 23', this shape serves to raise the sheets raised by the stabbing member 24 and the thickened portion 60 upon moving of the printing product 10 in conveying direction F, so that the ahead part 56 also enters between the sheets lifted off one another.

The passage 52, approximately elongate in the radial direction, has its greatest width, seen in the tangential direction, in its inner end region and is at its narrowest at the outer edge 54. In a preferred way, the stabbing end 26 lies, seen in the circumferential direction, at the trailing edge region 62 of the ahead part 56 and is offset with respect to the latter only in the direction of the pivot axis 18'. Seen in the direction of this pivot axis 18', the passage 52 preferably has a drop-like or wing-profile-like cross section. In the open position 23' of the opening element 18, the longitudinal direction of the passage 52 runs transversely to the conveying direction F, whereas in starting position 23 said longitudinal direction runs oppositely to the conveying direction F.

The disk-segment-like opening element 18 is mounted freely pivotally about the axis 18' on a carrying element 64, made from a rigid or, if appropriate, a flexibly compliant material. On this carrying element 64 there is further arranged in a swivelling manner a two-armed, angled-off actuating lever 66, the end of which facing the opening element 18 is jointedly connected to said opening element by means of a link plate 68. The point of attachment of the link plate 68 on the opening element 18 is eccentric with respect to the pivot axis 18', running at right angles to the resting surface 34, so that the opening element 18 is pivoted upon swivelling of the actuating lever 66. On the actuating lever 66 there is further mounted freely pivotally, at the end facing away from the opening element 18, a follow-up roller 70, which interacts with a control surface 72 of a pivoting slotted link 72', in order to swivel the actuating lever 66, against the action of a tension spring 74, and consequently the opening element 18 out of the open position 23' into the starting position 23. The swivelling back from the starting position 23 into the open position 23' takes place by the force of the tension spring 74, the control surface 72 being able to dictate the swivel position. For the sake of completeness, it is mentioned that the tension spring 74 acts between the arm of the actuating lever 66 facing the opening element 18 and the carrying element 64.

Figure 7:
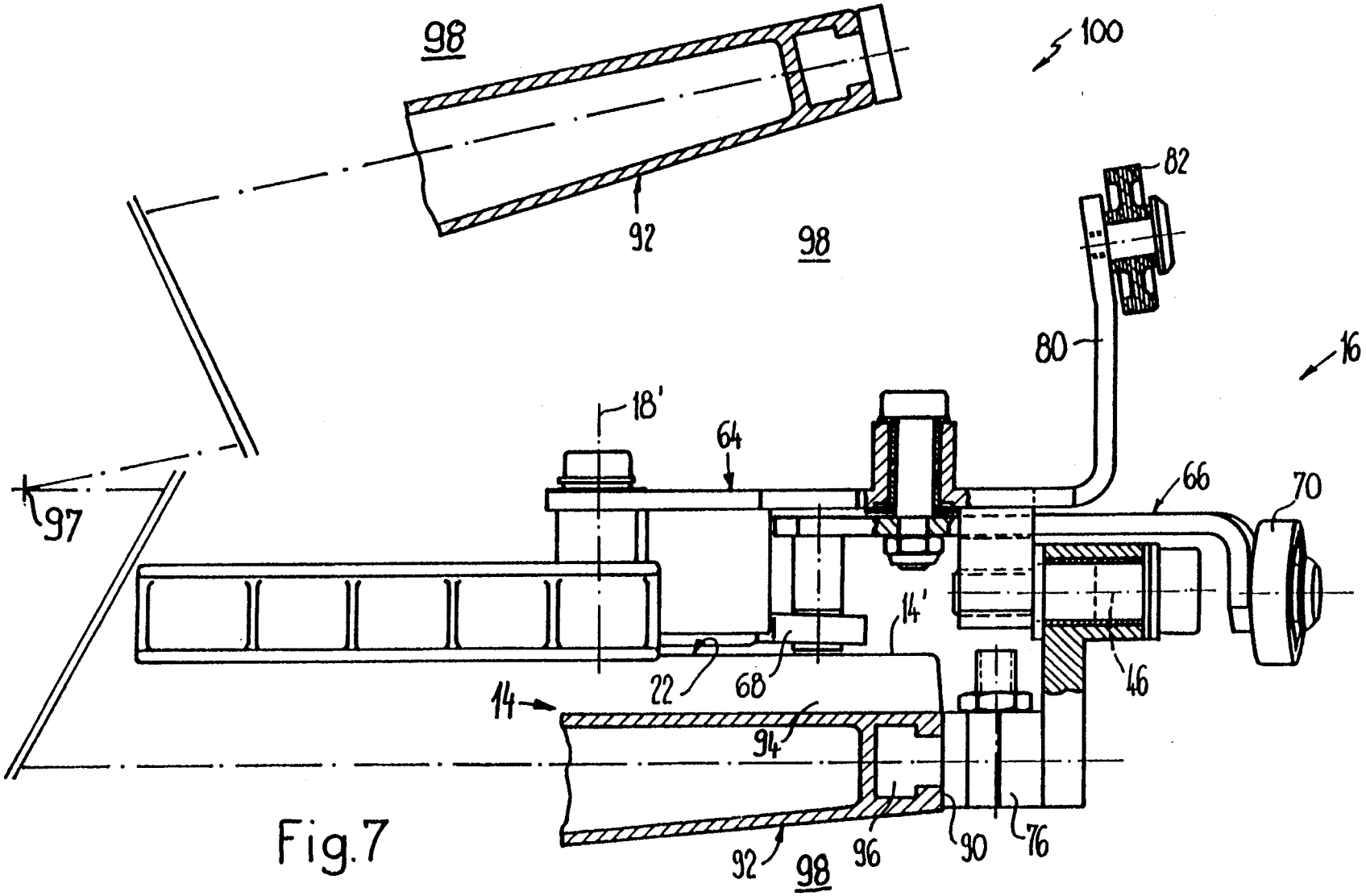
FIG. 7 shows, partially in section, a side view in the direction of the arrow VII of FIG. 4.

The carrying element 64 is in turn mounted on a fastening member 76 in such a way that it can swivel about the swivel axis 46, running approximately parallel to the supporting surface 14' and at right angles to the conveying direction F (see in particular FIG. 7). Formed on the carrying element 64 is a control lever 80, which runs approximately in the radial direction with respect to the swivel axis 46 and bears at its free end a freely rotatably mounted control roller 82. Fastened on the control lever 80 is one end of a second tension spring 84, the other end of which acts on the fastening member 66 and draws the carrying element 64 together with the opening element 18 in the direction toward the position of rest 47 remote from the supporting element 14, where the carrying element 64 is supported in a known way against the force of the second tension spring 84. The control roller 82 interacts with the control surface 86 of a swivelling slotted link 86', which swivels the carrying element 64, and consequently the opening element 18, against the force of the second tension spring 84, into the pressure-applying position 47'.

On the carrying element 64 there is further fastened the separating member 36, which is thickened in a wedge-like manner in conveying direction F. Its front edge 88, facing the opening element 18, aligns with the flat opening element 18 and, in the starting position of the opening element 18, is adjacent the edge of the latter facing the front edge 88, so that the sheets lifted off one another of the printing product 10 transported in conveying direction F are inevitably moved past on both sides of the separating member 36.

The fastening member 76 is fastened on the supporting element 14 in the end region 90 of the latter facing away from the transporting device 12. The supporting element 14 has a profile-like wall element 92, on which a supporting plate 94, forming the supporting surface 40' is fastened The wall element 92 has in its end region 90 an undercut fastening groove 96, which runs in the longitudinal direction and on which the fastening member 76 is fastened in a known manner such that it can be displaced and fixed.

As FIG. 7 reveals, a plurality of supporting elements 14 are arranged in a known manner about a common axis of rotation 97, these supporting elements 14 bounding receiving parts 98, which run in the longitudinal direction of the axis of rotation 97 and open on the radial outside. On the bottom of each of these receiving parts 98 there is arranged a transporting device 12 with clips 44 (see FIGS. 1 to 3), in order to displace in the longitudinal direction of the axis of rotation 97 the printing products 10, together with supplements 42, introduced into the receiving parts 98. Several of the parts, shown in FIGS. 1 to 3, of the device for processing the printing products 10 may be arranged about a common axis of rotation 97 according to FIG. 7 and consequently form a processing drum 100, on which the printing products 10 introduced into the receiving parts 98 at a feeding point 40 are opened and transported by one step in conveying direction F in each case during the course of one revolution about the axis of rotation 97. Devices of this type are known, for example., from the following publications: CH-Pat. No. 584,153 Pat. No. 3,951,399 CH-Pat. No. 575,303and U.S. Pat. No. 4,058,202.

Figure 8:
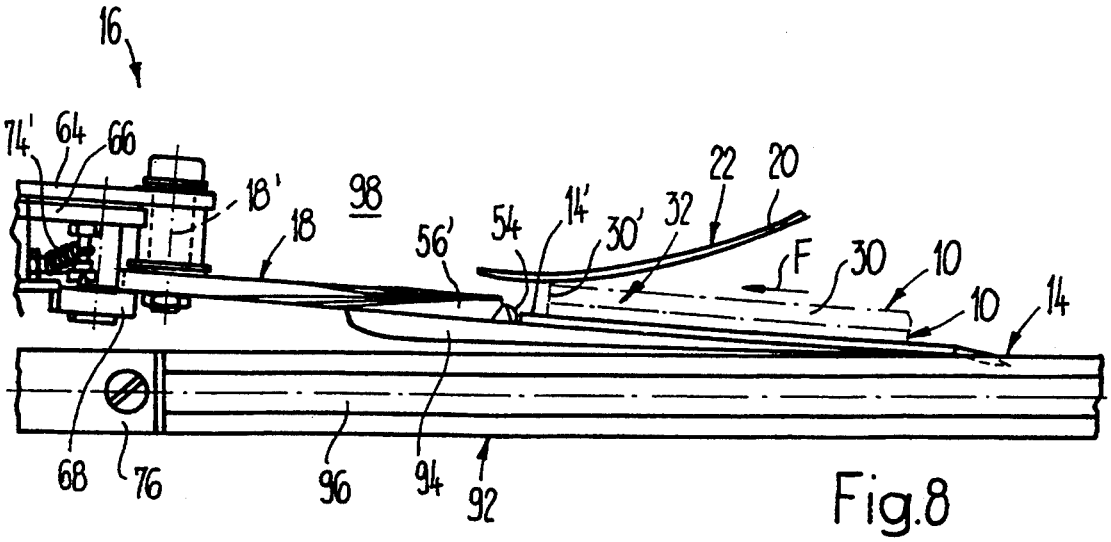
FIGS. 8 and 9 show a part of FIG. 3 enlarged, in elevation and plan view.
Figure 9:
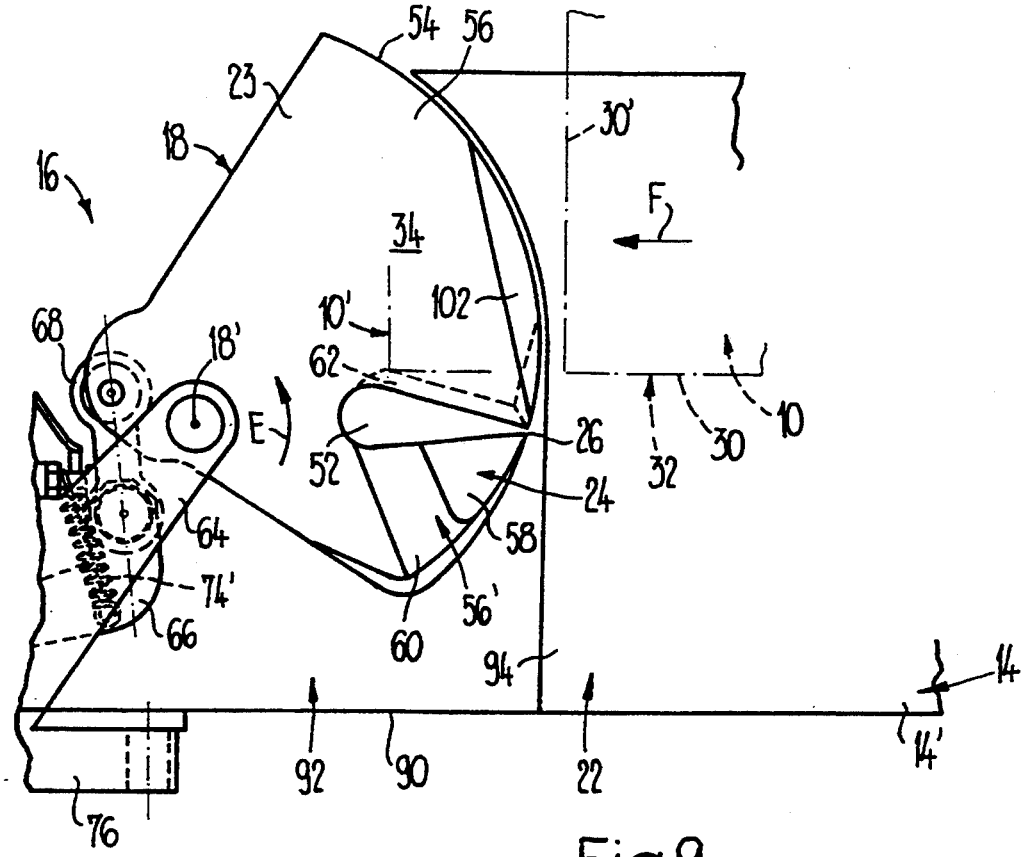

In FIGS. 8 and 9, the opening apparatus 16 indicated in FIGS. 1 and 3 is shown enlarged. The construction and operating principle of the opening apparatus 16 shown in FIGS. 8 and 9 correspond substantially to that configuration shown in FIGS. 4 to 7. Therefore, reference is made expressly to the corresponding description. In FIGS. 8 and 9, the reference symbols are indicated only to the extent necessary for understanding. A difference in the construction of the opening apparatus 16 according to FIGS. 8 and 9 in comparison with the configuration according to FIGS. 4 to 7 is that the carrying element 64 is arranged fixedly on the fastening member 76, consequently the carrying element 64 with the opening element 16 cannot be swivelled about an axis running approximately parallel to the supporting surface 14'. Furthermore, the opening element 18 is itself designed symmetrically with respect to the opening element of the configuration according to FIGS. 4 to 7. The planar resting surface 34 on the ahead part 56 is located on the upper side of the opening element 18, ie. the side facing away from the supporting element 14. This resting surface 34 aligns substantially with the supporting surface 14' or is offset slightly in the downward direction with respect to the latter. The stabbing end 26 of the stabbing member 24 is offset upward by a predetermined distance A in the direction of the pivot axis 18' with respect to the resting surface 34. Furthermore, the ahead part 56 has along one section of its radially outer edge 54 a ramp-like slope 102 with respect to the resting surface 34, which slope is directed against the conveying direction F when the opening element 18 is swivelled into the starting position 23. This is to ensure that the printing products 10 transported while lying on the supporting element 14 are certain to slide onto the opening element 18. It is to be noted that, in the case of this configuration, the supporting plate 94 of the wall element 92 is designed as rising toward the opening apparatus 16, seen in conveying direction F, and ends at a small distance before the outer edge 54 of the opening element 18.

The printing product 10 to be opened is advanced in conveying direction F into the position denoted in FIG. 9 by 10'. Then, the opening element 18 is swivelled in stabbing direction E, whereby the stabbing member 24 stabs with the stabbing end 26 into the open side 30 and, upon further pivoting, the following part 56' raises the sheets of the printing product 10 which are resting thereupon off the sheets facing the supporting element 14. With opened printing product 10, the open position 23' of the opening element 18 corresponds to that position which is represented in FIG. 6 by solid lines. For the sake of completeness, it should be mentioned that the pressure applying element 20, acting as counter-element 22 and designed like a leaf spring, presses the printing products 10 against the resting surface 34 and holds the latter in a defined manner at the stabbing region 32 with sheets bearing one against the other.

In the case of this configuration, the tension spring 74', arranged between the actuating lever 66 and the fastening member 76, acts in the opposite direction in comparison with the tension spring 74 (compare FIG. 5), ie. the opening element is urged by the tension spring 74' toward the starting position 23. For pivoting into the open position 23', a pivoting slotted link 72' acts with its control surface 72 against the tension spring 74' on the follow-up roller 70.

Figures 10, 11, 12, 13, 14, 15:
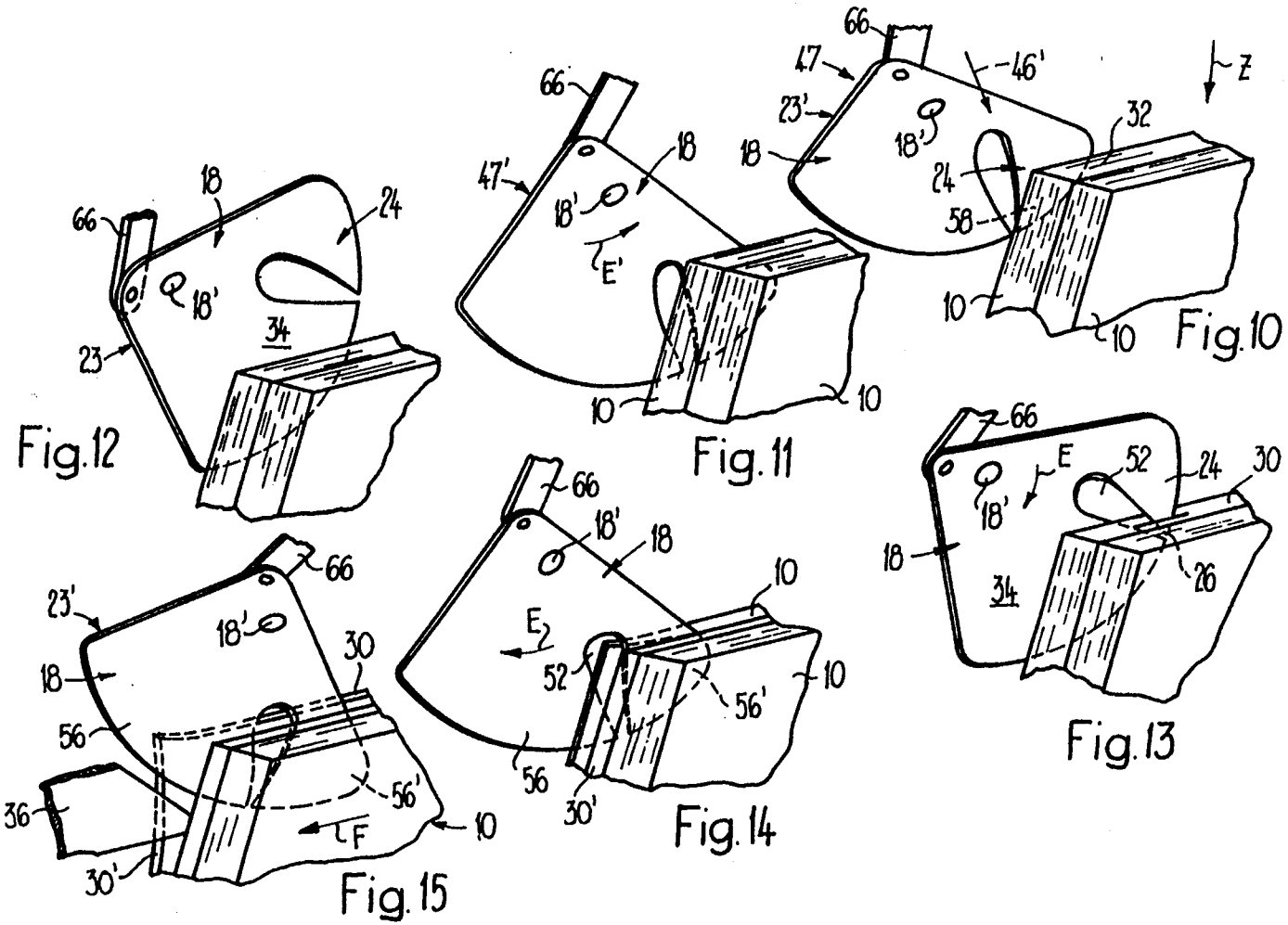
FIGS. 10 to 15 show a part of the apparatus according to FIG. 2 at six different points in time during opening of a printing product.

The opening of a printing product 10 by the opening apparatus 16 according to FIGS. 4 to 7 is shown step by step in FIGS. 10 to 15. By swivelling out of the position of rest in arrow direction 46' into the pressure-applying position 47', the opening element 18 is set down onto the two printing products 10, fed in feeding direction Z, whereby the printing products 10 are held together at the stabbing region 32, since they rest on the side facing away from the opening element 18 on the supporting element 14, not shown in these figures but acting as counter-element 22. As FIG. 10 shows, the opening element 18 is thereby swivelled into the open position 23' and comes to bear with the planar region 58 of the stabbing member 24 onto the flat side of the printing product 10 to be opened (see FIGS. 10 and 6).

As FIG. 11 reveals, the opening element 18 is then pivoted against the stabbing direction E, as is indicated by the arrow E'. As a results the printing product 10 to be opened is smoothed. This pivoting of the opening element 18 takes place until it has reached the starting position 23, which is shown in FIG. 12. In this position, the opening element 18 bears only with the resting surface 34 on the printing product 10 and the stabbing member 24 has run off the printing product 10. In order to compensate in this case for the distance A between the stabbing end 26 and the resting surface 34, either the swivelling slotted link 86' is correspondingly designed or suspended in a sprung manner or the suspension of the opening element 18 has a resilience of its own.

The opening element 18 is then pivoted out of the starting position 23 in stabbing direction E. During this pivoting, the stabbing member 24 stabs with the stabbing end 26 into the open side 30, as FIG. 13 shows. The reference for the point of stabbing is in this case provided by the supporting surface 34, which bears against the printing product 10 and brushes over the latter. The sheets which are to be lifted off the sheets between the stabbing member 24 and the supporting element 14 thereby come into engagement with the passage 52.

FIG. 14 shows the opening element 18 shortly before it has reached the open position 23' again. It can be clearly seen here how the sheets to be lifted off of the printing product 10, engaging in the passage 52, are lifted off the remaining sheets and the printing product 10 is opened in the region of the leading side 30'. In the open position 23', the ahead part 56 is swivelled out of the region of the printing product 10 and the opening element 18 then engages alone with the following part 56' between the sheets lifted off one another.

The previously opened printing product 10 is then further transported in conveying direction F by means of the transporting device 12 (see FIGS. 1 to 3), the ahead part 56 of the opening element 18 then also coming to lie between the sheets lifted off one another (FIG. 15). At the same time, the printing product 10 is conveyed toward the separating member 36, which opens the printing product 10 completely when it is transported past.

In an analogous way, printing products are opened by the opening apparatus 16 according to FIGS. 8 and 9, in the case of this embodiment only the steps according to FIGS. 12 to 15 taking place; ie. the opening element 18 is swivelled into the starting position 23 before the printing product 10 to be opened is conveyed into the region of the opening apparatus 16.

It goes without saying that it is also possible, in the case of the configuration of the opening apparatus 16 according to FIGS. 2 and 4 to 7, to dispense with the smoothing of the printing products 10. In this case as well, the opening element 18 is swivelled into the starting position 23 before it is brought with its resting surface 34 into the pressure-applying position 47' to bear on the printing products 10.

It goes without saying that it is also conceivable to move a correspondingly designed opening element 18 translatorially, instead of pivoting, in order to open printing products 10.

For the sake of completeness, it should be mentioned that the printing products can be opened on any desired open side. It goes without saying that the printing products may also be moved in conveying direction F during opening.

The apparatus according to the invention is suitable for opening any desired multi-sheeted, folded, bound or stapled products.

I claim:

1. A process for opening folded, bound or stapled multi-sheeted products in which a stabbing member (24) of an opening element (18) is used to stab in between sheets of the product (10) on one of its open sides (30) in a stabbing region (32) and, by subsequent moving of the opening element (18), the sheets lying on one side of the stabbing member (24) are lifted off the remaining sheets, wherein the product (10) is held together at the stabbing region (32) between a resting surface (34) of the opening element (18) and a counter-element (22), interacting with said resting surface, the held-together product (10) is stabbed by moving the opening element (18) in a stabbing direction (E) with a stabbing end (26) of the stabbing member (24), which end is offset by a predetermined distance (A) in the direction toward the counter-element (22) with respect to the resting surface (34), and the sheets are lifted off one another by subsequent further moving of the opening element (18).

2. The process as claimed in claim 1, wherein the product (10) is opened by pivoting the opening element (18) about an axis (18') running transversely to the flat sides of the product (10).

3. The process as claimed in claim 1, wherein the product (10) partially opened by means of the opening element (18) is moved with an opened side (30') ahead toward a fixed separating member (36, 36'), entering between the sheets lifted off one another, and past the said separating member in order to open the product (10) completely.

4. The process as claimed in claim 1, wherein, before opening, the product (10) arranged between the opening element (18) and the counter-element (22), is smoothed in the stabbing region (32) by pivoting the opening element (18) bearing against the product (10) against the stabbing direction (E).

5. An apparatus for opening folded, bound or stapled multi-sheeted products having an opening element (18) with a stabbing member (24) for stabbing between sheets of the product (10) on one of its open sides (30) in a stabbing region (32), the opening element (18) being movable for lifting the sheets lying on one side of the stabbing member (24) off the remaining sheets, wherein the opening element (18) has a resting surface (34) interfacing with a counter-element in order to hold together the product (10) between said opening element and the counter-element (22) at the stabbing region (32), a stabbing end (26) of the stabbing member (18) is offset by a predetermined distance (A) in a direction toward the counter-element (22) with respect to said resting surface (43), and the opening element (18) is movable in order to stab with the stabbing member (24) in a stabbing direction (E) into the held-together product (10) and to lift the sheets off one another upon subsequent further moving.

6. The apparatus as claimed in claim 5, wherein the opening element (18) can be pivoted about an axis (18') running transversely to the resting surface (34).

7. The apparatus as claimed in claim 6, wherein the opening element (18) is designed in a substantially disk-like configuration and has a passage (52) which runs transversely to the resting surface (34) and is open at the edge (54) of the opening element (18) radially on the outside with respect to the axis running transversely to the resting surface (18'), and wherein the resting surface (34) is substantially planar and is made on a part (56) of the opening element (18) ahead of the passage (52), seen in the stabbing direction (E), and the stabbing member (24) is made on a part (56') of the opening element following the passage (52).

8. The apparatus as claimed in claim 7, wherein the passage (52) has, seen in the direction of the axis (18')

running transversely to the resting surface, a cross section which is elongated slightly in the radial direction and forms a substantially drop-like configuration with the smallest width at the edge of the opening element (18).

9. The apparatus as claimed in claim 5, further comprising a supporting element (14) and transport means (12) for moving the products resting on the support element (14) in a conveying direction wherein, seen in said conveying direction (F), arranged downstream of the opening element (18) there is a fixed, substantially wedge-like separating member (36, 36'), which is spaced apart from the supporting element (14) and can be entered between the sheets partially lifted off one another by means of the opening element (18), in order to open the product (10) completely.

10. The apparatus as claimed in claim 9, wherein the resting surface (34) of the opening element (18) aligns approximately with a supporting surface (14') of the supporting element (14), and the counter-element (22) has a spring pressure-applying element (20), in order to press the product (10) against the resting surface (34).

11. The apparatus as claimed in claim 9, wherein the supporting element (14) acts as the counter-element, and the opening element (18), is swivelable about a swivel axis (46) running approximately parallel to a supporting surface (14') of the supporting element, can be brought out of a position of rest (47), into a pressure-applying position (47') which is adjacent the supporting element (14) and in which the opening element (18) presses the product (10) against the supporting element (14) in order to hold the product together at the stabbing region (32).

12. The apparatus as claimed in claim 11, wherein, upon bringing into the pressure-applying position (47'), the opening element (18) comes to bear with the stabbing member (24) against the product (10), for smoothing of the product (10) and which can be pivoted against the stabbing direction (E), until it bears with the resting surface (34) against the product (10), and which is then pivoted in the stabbing direction (E) to permit opening.

13. The apparatus as claimed in claim 9, wherein, for opening the product (10), the opening element (18) can be pivoted out of a starting position (23), in which the opening of a passage (52) at the edge (54) of the opening element (18) is directed against a conveying direction (F), in the stabbing direction (E) into an open position (23'), in which the longitudinal direction of the passage (52) runs approximately at right angles to the conveying direction (F), and wherein an axis (18') running transversely to the resting surface is arranged in such a way that the radially inner end of the passage (52) can be moved past the product (10).

14. A device for processing printing products, having a processing drum comprising a plurality of receiving parts (98), which are arranged about a horizontal axis of rotation, run approximately in the direction of the horizontal axis of rotation, are open on the radial outside and into which a printing product (10) can be introduced, with the back margin (28) of said product leading, in each case at a feeding point (40), having transport means (12) for transporting the introduced printing products (10) in the direction of the horizontal axis of rotation during the rotating of the receiving parts, and having attached to each receiving part an apparatus for opening the respective printing product, the apparatus having an opening element with a stabbing member for stabbing between sheets of the product on one of its open sides in a stabbing region, the opening element being movable for lifting the sheets lying on one side of the stabbing member off the remaining sheets, wherein the opening element has a resting surface interfacing with a counter-element in order to hold together the product between said opening element and the counter-element at the stabbing region, a stabbing end of the stabbing member is offset by a predetermined distance in a direction toward the counter-element with respect to the resting surface, and the opening element is movable in order to stab with the stabbing member in a stabbing direction into the held-together product and to lift the sheets off one another upon subsequent further moving thereof.

15. The device as claimed in claim 14, wherein carrying members (64) for the opening elements (18) are arranged on walls (92) of the receiving parts in their radially outer end regions (90), and control elements interacting with fixed control surfaces, are mounted on the carrying members (64) for pivoting the opening elements (18).

16. The device as claimed in claim 14, wherein carrying members (64) are able to swivel about a swivel axis running transversely to the axis of rotation and are spring-loaded, in order to keep the opening elements (18) in the position of rest (47), and wherein follow-up elements (82), interacting with a further control surface (86) arranged outside a processing drum (100) and spring, are arranged on the carrying members (64), in order to swivel the opening elements (18) into a pressure-applying position (47').

* * * * *